US006096956A

United States Patent [19]

Hoshino

[11] Patent Number: 6,096,956

[45] Date of Patent: Aug. 1, 2000

[54] CLAMP DEVICE FOR MUSICAL INSTRUMENTS

[75] Inventor: Yoshihiro Hoshino, Nagoya, Japan

[73] Assignee: Hoshino Gakki Co., Ltd., Japan

[21] Appl. No.: 09/392,991

[22] Filed: Sep. 9, 1999

[30] Foreign Application Priority Data

Jan. 22, 1999 [JP] Japan ..... 11-014698

[51] Int. Cl.[7] ..... G10D 13/02

[52] U.S. Cl. ..... 84/421; 84/422.3; 84/453; 148/230.4; 148/219.3

[58] Field of Search ..... 84/421, 422.3, 84/453; 248/218.4, 219.3, 230.4

[56] References Cited

U.S. PATENT DOCUMENTS 4,852,840 8/1989 Marks ..... 248/230.4

*Primary Examiner*—Stanley J. Witkowski
*Assistant Examiner*—Shih-yung Hsieh
*Attorney, Agent, or Firm*—Ostrolenk, Faber, Gerb & Soffen, LLP

[57] ABSTRACT

A clamp device having a main body and a pivotable, pipe clamping holder. A first bolt and nut connect the main body and the pivotable holder and allow them to pivot with reference to the first bolt. Another bolt is pivotally connected to the main body and can be swung in a groove in the second holder and the other nut is held in the groove by a respective nut. The two bolts cooperate to clamp a pipe. An arm to one side of the second holder and the main body is operable for pivoting the second holder around the second bolt to selectively open or close the clamping against the main body. A spring on the first bolt biases the second holder contrary to the force applied to the arm. The main body extends to a further clamping hole. An additional pipe holding, adjustable angle member may be installed in the further hole.

11 Claims, 7 Drawing Sheets

CLAMP DEVICE FOR MUSICAL INSTRUMENTS

BACKGROUND OF THE INVENTION

The present invention relates to a clamp device for holding musical instruments such as cymbals, etc.

EXAMPLE OF PRIOR ART

FIGS. 9 and 10 show a known clamp 100 for supporting a second cymbal S2 on the pipe SP of a musical instrument stand ST on which there is also a first cymbal S1. Known clamps 100 of this type for musical 10 instruments, as shown in FIG. 10, have a clamp main body 110 including at least one first holder 111 for the pipe SP (P) and a second holder 120 arranged opposite the clamp main body 110. The holder 120 is supported to approach or move away from the clamp main body 110 using a first tightening bolt 130 and a cooperating first nut 135 and a second tightening bolt 140 and a cooperating second nut 145 that are on both sides of and that sandwich the holder 111 laterally between them. The clamp structure for the pipe SP and the clamp for the other pipe P are the same, being symmetrical between the right and the left.

A cut groove 112 at the outward end of the clamp main body 110 allows a first tightening bolt 130 to be freely swingable in an out around a pivot at 131 that extends across the main body 110. An installation hole 113, transverse to the pivot at 131, passes through the body 110 for receiving a second tightening bolt 140. An insertion groove 121 formed at the outward terminal end of the holder 120 receives the first tightening bolt 130 as the bolt is swung around, and the groove 121 engages the second nut 135. A cut groove 122 is formed at the other terminal end of the holder 120 for receiving the second tightening bolt 140, and the holder 120 is also freely swingable around a pivot at 141 on bolt 140.

There is a pin 131 of the first tightening bolt 130 about which that bolt pivots. A spring 132 maintains tension on the bolt and prevents its undesired rotation. A washer 136 is provided on the side of the first nut 135 and the spring presses upon the washer. There is a pin 141 for the second tightening bolt about which the holder 120 swings. A spring 142 maintains tension on the bolt 140 to prevent its undesired rotation. A washer 146 is provided on the side of the second nut 145.

To install the pipe SP (or P) using the clamp 100, the second tightening bolt 140 is inserted through the installation hole 113 of the clamp main body 110. The second nut 145 is screwed on the screw part of the bolt 140. This links the clamp main body 110 and the holder 120 at first.

Then the first tightening bolt 130 on the terminal side of the clamp main body 110 is pivoted outward around the pin 131 as the pivot axis, thereby opening the bolt 130 to the outside. At the same time, the holder 120 is opened outwardly or down in FIG. 10, with the pin 141 of the second tightening bolt 140 as the pivot axis, to define an opening D. The holder 111 of the clamp main body 110 is applied against the side of the pipe SP in the opening D.

Next, the bolt 130 is swung around its pivot 131 closing the first tightening bolt 130 toward the holder 120. The first tightening bolt 130 is inserted into the insertion groove 121 of the holder 120 where it engages the first nut 135 outside of or below the insertion groove 121. While the height adjustment of the pipe SP along the clamp 100 is being carried out, the first nut 135 and the second nut 145 are also tightened for fixing the pipe P, as shown at the left in FIG. 10.

A clamp as described above is disclosed in Japanese Official Publication, Toku Ko Hei 4-42880, as an example. It has the advantage of enabling installation and removal of the pipe from the side, easing installation and dismantling.

In this known clamp, free pivoting is inevitable in connection with the installation as the tightening bolts 130 and 140 on both sides of a holder 111 for the pipe are freely swingable on the clamp main body 110 or the holder 120 around their pivot pins 131 and 141.

In other words, the holder 120 engages freely rotatably with the axis pin 141 of the second tightening bolt 140 as the pivot center and the first tightening bolt 130 engages freely rotatable, with the axis pin 131 of the clamp main body 110 as the pivot center, in connection with combining the clamp main body 110 and the holder 120. Accordingly, to install the pipe member SP (P), while grasping the holder 120 and the first tightening bolt 130 by hand, it is necessary to engage the first tightening bolt 130 into the insertion groove 121 of the holder 120. Such an operation is troublesome and inconvenient.

SUMMARY OF THE INVENTION

In view of the foregoing, the present invention provides a clamp for musical instruments which is capable of simple and quick installation, permitting use of one hand, by controlling the free swinging of the constituent parts during the installation of the pipe.

This invention concerns a clamp having a clamp main body which includes a first holder for a pipe and a second holder arranged in opposition to the clamp main body. The second holder is supported to be freely movable toward or away from the clamp main body by a first tightening bolt and a first nut forming the main clamp body and the second holder on one lateral side of the pipe and by a second tightening bolt and a second nut forming the main clamp body and the second holder on the other lateral side of the installed pipe, with the pipe sandwiched between the second holder and the main body.

The first tightening bolt is held freely pivotable around a pivot in a cut groove at one end of the clamp main body. The first tightening bolt is inserted into the insertion groove at one end of the second holder and the first bolt is engaged outside of the insertion groove by a first nut that is screwed to a screw thread on the first bolt. A spring around the first tightening bolt is between a washer on the main body side and a washer on the nut side of the first tightening bolt to bias the washers outward at all times. The washer against the main body inhibits pivoting of the first bolt. The washer on the main body side slides in contact with the outer peripheral surface of the clamp main body that defines the cut groove during swinging or pivoting of the first tightening bolt.

The second tightening bolt is protuberantly provided against the second holder in an installation hole in the second holder and isolated on the other side of the pipe. The second tightening bolt enables the second holder to swing with respect to the clamp main body. The second bolt passes through a through hole in the main body at the other terminal of the second holder. The second bolt is to be engaged outside of a bolt through hole through the main body by a second nut that is screwed to the second bolt. A second spring urges the second holder in an outward direction. The second spring extends between the clamp main body and the second holder and is around the second tightening bolt. An arm protrudes to the side of the clamp main body member at the terminal which is opposite to the intersection groove of the holder. A guide window is formed in the clamp main body which an arm of the second holder enters, making it possible for movement of the arm in the longitudinal direction, while regulating movement of the arm in the width direction.

In addition, the invention relates to the structure of a clamp for musical instruments, with a concave groove on the outside of the through hole of the holder having a curved face in the width direction that which crosses the through hole at a right angle. Moreover, a stripe is formed on the lower surface of the second nut having a curved surface in the width direction which crosses, at a right angle, the central part of the nut, in opposition to the concave groove.

The invention further relates to a clamp device for musical instruments, wherein a third cut is formed in a continuation of the clamp device with a post holding hole located at the terminal on the opposite side of the cut terminal of the clamp body. A third tightening bolt and a third nut for tightening and loosening the third cut are formed.

Moreover, the invention relates to a clamp device, wherein a holder main body is installed at the holding hole. A fourth tightening bolt has a rod insertion hole and is installed through an angle adjusting member in the holder so that it may be tightened and fixed by a fourth nut.

Other objects and features of the invention are explained below with reference to the accompanying drawings.

DESCRIPTION OF A PREFERRED EMBODIMENT

Figure 1:
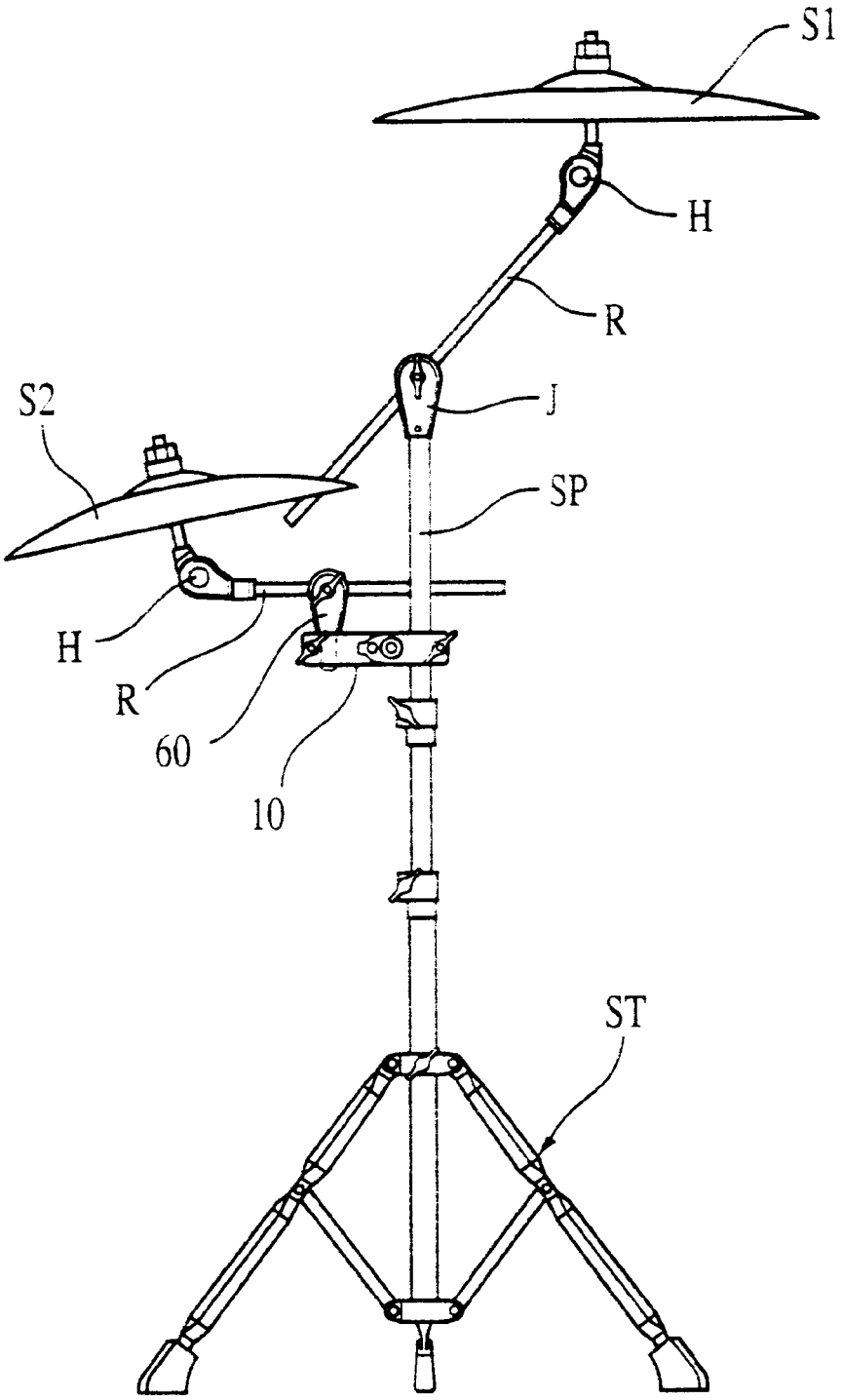
FIG. 1 is a front view of a cymbal stand showing an example of a clamp device for musical instruments according to the invention applied to a cymbal stand.

A clamp device 10 for musical instruments according to this invention is used where, for instance, a second cymbal S2 is attached to a cymbal stand ST that holds a first cymbal S1, as shown in FIG. 1. A pipe SP is the main post of the cymbal stand. A respective holding rod R carries the first cymbal and the second cymbal. A linkage holder J links the rod R of the first cymbal S1 and the pipe SP.

Figure 2:
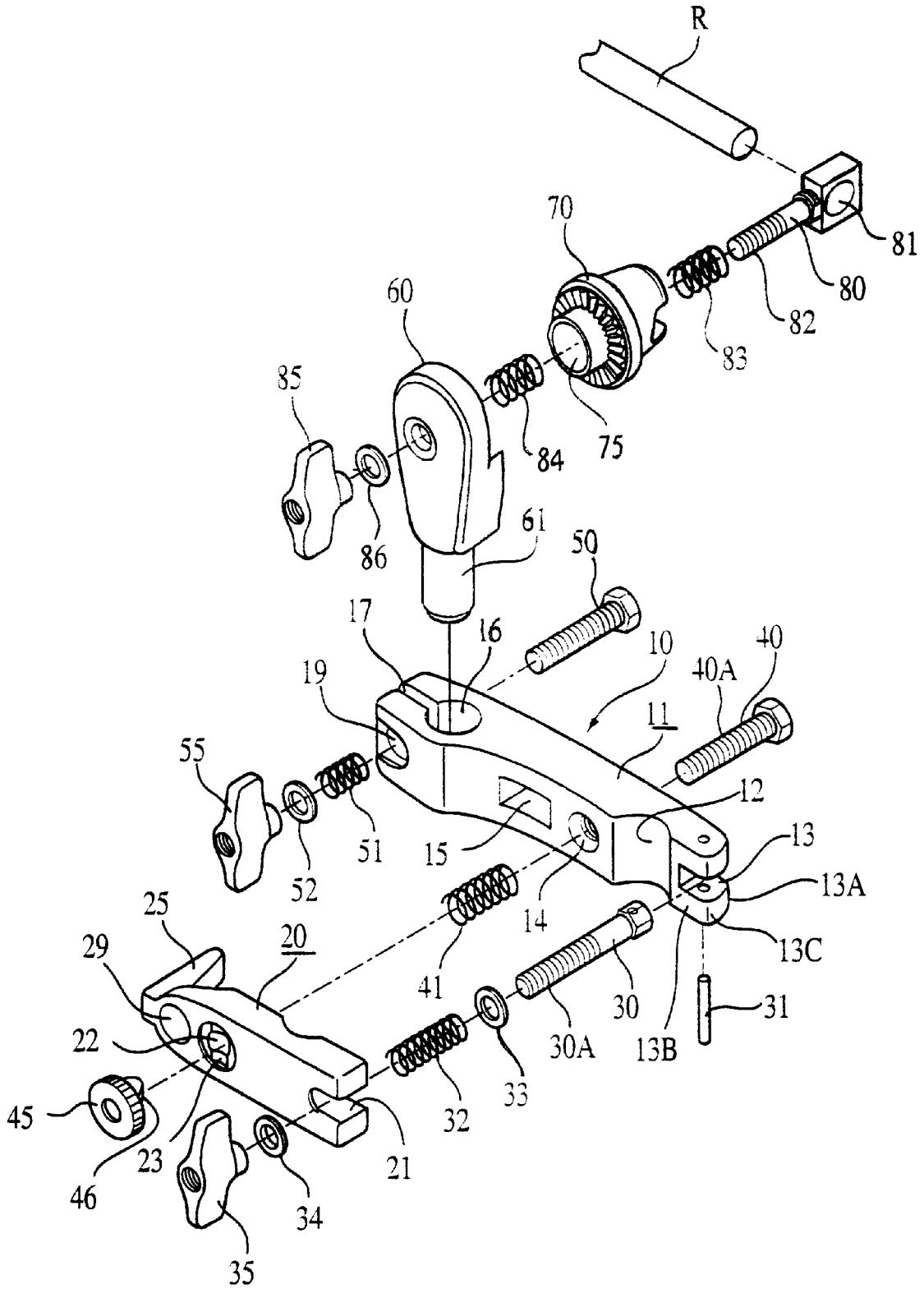
FIG. 2 is an oblique, exploded perspective view of the entire clamp device for musical instruments.

In FIG. 2 the clamp 10 has a clamp main body 11 which includes a first holder 12 for the pipe SP and the clamp has another second holder 20 that is arranged opposed to the clamp main body 11. The second holder 20 is moved toward or away from the clamp main body 11 by the first tightening bolt 30 and the cooperating first nut 35 and by the second tightening bolt 40 and the second nut 45 which are disposed on both lateral sides of and thereby sandwich the holder 12 (and the pipe it holds) between the bolts.

Figure 3:
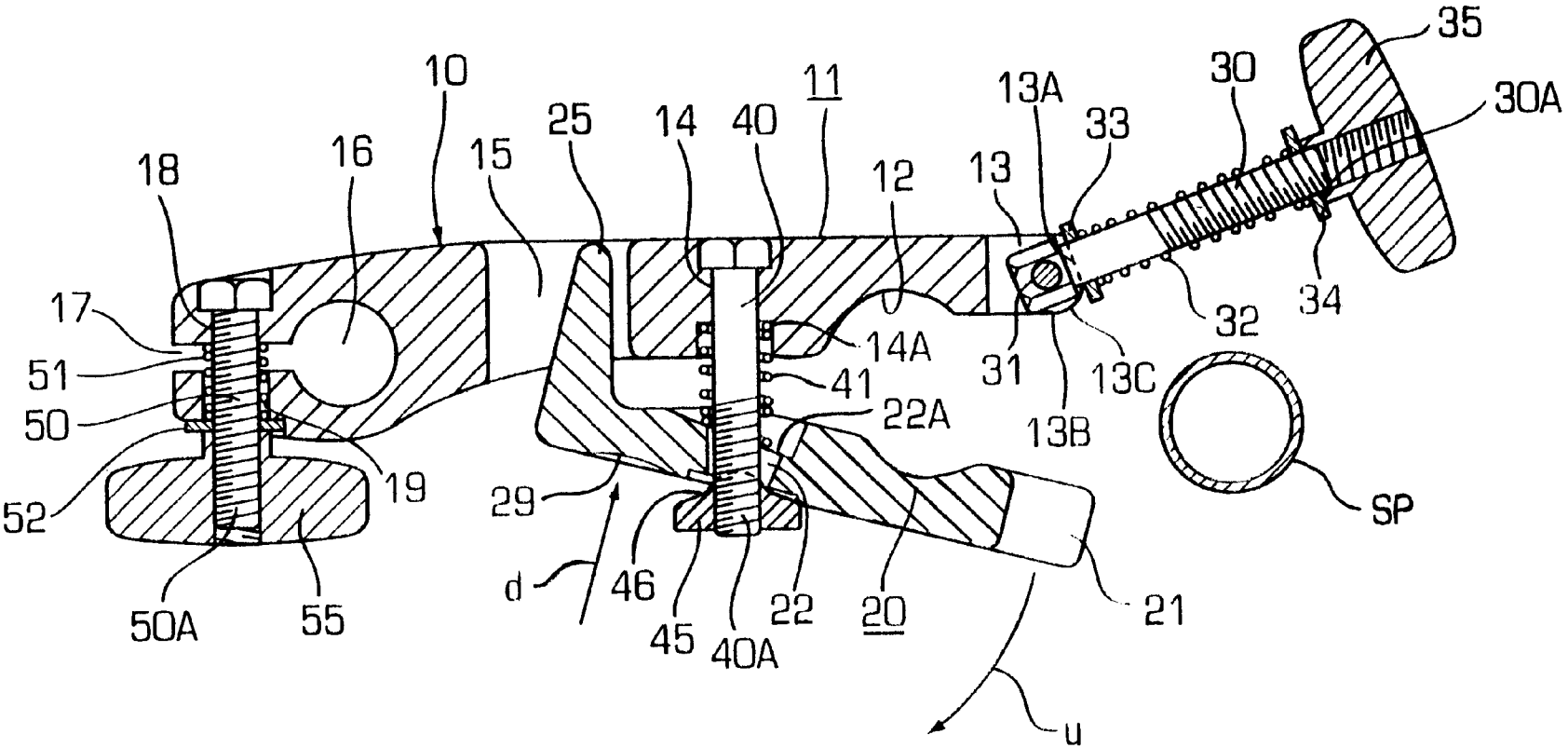
FIG. 3 is a cross section showing the open state of the clamp device.
Figure 4:
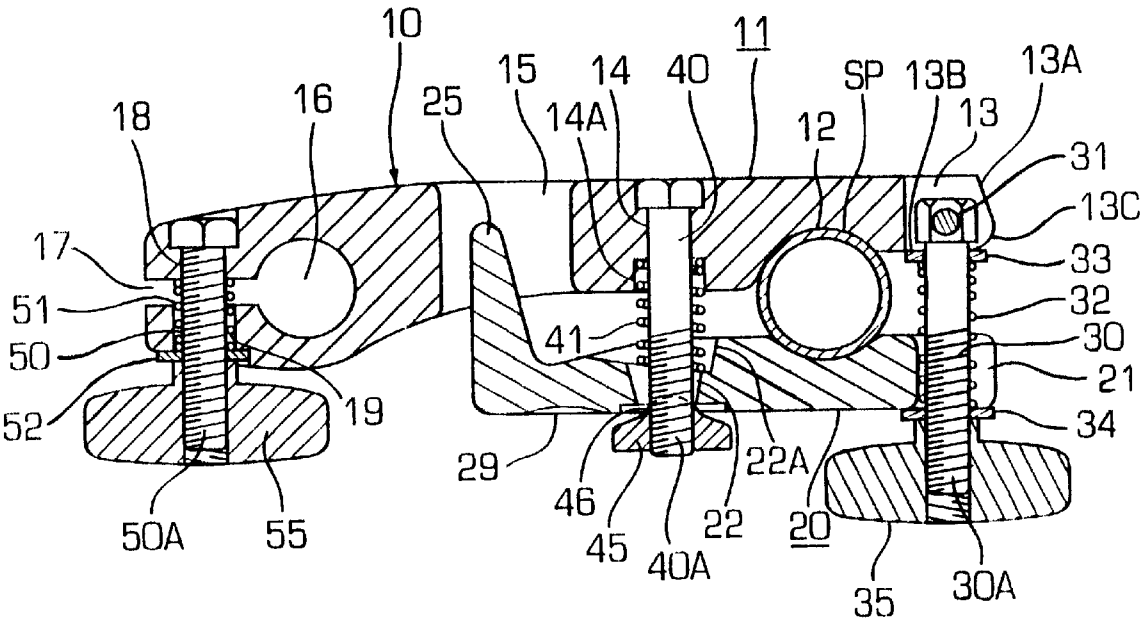
FIG. 4 is the same cross section showing the closed state of the clamp device.

As seen in the oblique view in FIG. 2 and the cross sectional views in FIGS. 3 and 4, the first tightening bolt 30 is held at its end in a freely pivotable fashion by an axial pin 31 that is disposed in the cut groove 13 at one of the terminal ends of the clamp main body 11, so that the bolt 30 may pivot with respect to the second holder 20.

The first tightening bolt 30 is swingable and it engages the outside of the insertion groove 21 by the first nut 35, as shown in FIG. 4. That nut is inserted into the insertion groove 21 which is at one terminal end of the holder 20, and the nut is screwed to the screw 30A.

In addition, a compression spring 32 between the washer 33 on the main body side and a washer 34 on the nut side around the first tightening bolt 30 biases these washers 33 and 34 in an outward direction. The washer 33 on the main body side may slide in contact with the outer peripheral surface 13A of the cut groove 13 of the clamp main body 11 during pivoting of the first tightening bolt 30.

On the outer surface of the cut groove region 13, where the washer 33 on the main body side slides, surface 13A of the body 11 corresponds to the open position (shown in FIG. 3) and surface 13B corresponds to the closed position (shown in FIG. 4). They are shaped flat for providing stable holding of the bolt in either swung position. The angular region 13C that connects the planar surfaces 13A and B is preferably curved.

Free pivoting of the first tightening bolt 30 around the axis 31 is inhibited by the force of the spring 32. The bolt may be rotated while its pivot position is being maintained as it is pressed to the outer peripheral surface 13A of the cut groove 13 of the clamp main body member 11. This prevents unrestricted pivoting, thereby freeing the operator from the trouble of having to hold the bolt 30 with a hand.

Meanwhile, the second tightening bolt 40 is protuberantly provided in the installation hole 14 that is formed on the other lateral side of the main body from first bolt 30 to bracket the first holder 12 and urge the second holder 20 toward the clamp main body 11. This second tightening bolt 40 is constructed such that the holder 20 may pivot with respect to the clamp main body 11 along with the insertion groove 21 of the second holder 20 and the through hole 22 on the opposite terminal side. The second holder 20 may be engaged to the outside of the through hole 22 by the second nut 45 that is screwed on its screw shank 40A of the second bolt 40. A compression spring 41 disposed between the clamp main body 11 and the holder 20 biases against the holder 20 at all times.

There is a spring receiving concave depression 14A into the side of the clamp main body 11 and a spring receiving concave depression 22A in the opposing side of the second holder 20.

The through hole 22 is enlarged at least in the length direction of the holder 20, as seen in the cross sections in FIGS. 3 and 4, enabling the holder 20 to be swung, dependent upon the size of the hole.

Figure 5:
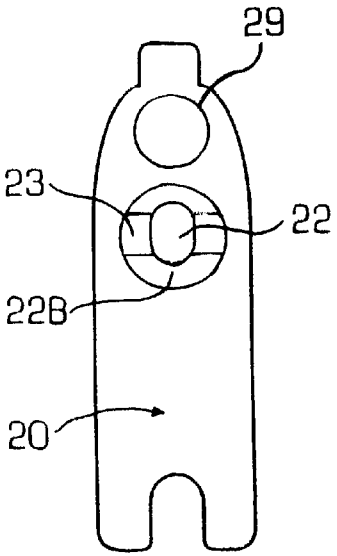
FIG. 5 is a front view of a holder component for the clamp device.
Figure 6:
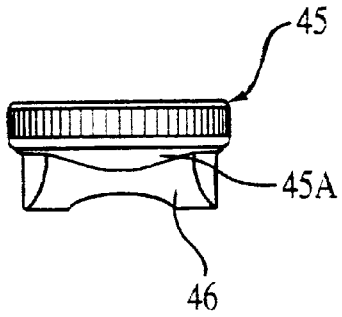
FIG. 6 is a side view of the second nut for the clamp device.

As shown in FIG. 5, there is a concave groove 23 having a curved surface in the width direction that crosses the through hole 22 at a right angle on the outside 22B of the through hole 22 in the holder 20. As shown in FIG. 6, on the lower surface 45A of the second nut 45, there is a protrusion 46 having a curved surface in the width direction that crosses the central part of the nut at a right angle and is opposed to concave groove 23.

The concave groove 23 of the holder 20 and the protrusion 46 of the nut 45 cooperate so that the protrusion 46 on the nut 45 that has been screwed on the screw part 40A of the second tightening bolt 40, enters the concave groove 23 of the holder 20 every half rotation, permitting the nut 45 to rotate with moderation. This also serves as a stopper against "loosening".

At the terminal end of the second holder 20, at the lateral side opposite the insertion groove 21, an arm 25 protrudes to the side of the clamp main body 11. The arm 25 of the holder 20 enters a guide window 15 in the clamp main body. This enables movement of the arm 25 in its longitudinal direction through the window 15 while it regulates the shift of the arm 25 in the width direction. The arm 25 of the holder 20 and guide window 15 of the clamp main body 11 enable the holder 20 to freely move to approach or move away from the clamp main body 11. However, movement of the clamp main body 11 in the width direction or in the up and down direction shown in FIG. 2 is controlled.

Since the arm 25 is so shaped and installed as to swing against the clamp main body 11 under the force of the second tightening bolt 40 and the second nut 45 thereon, the arm 25 can only move in directions approaching or moving away from the clamp main body 11. As the second holder 20 has a spring 41, if the arm 25 side of the holder 20 is pressed by a finger in the (upward) direction indicated by arrow d in FIG. 3, the second holder swings around the bolt 40, and the insertion groove 21 side of the holder 20 opens, as indicated by arrow u. Then if the force applied at the side of the arm 25 is released, the insertion groove 21 side is closed due to the continuing bias by the spring 41. Therefore, the second holder 20 acts like a clothespin against the main body 11. A finger applying area 29 assists in this clothespin like action.

Accordingly, opening and closing of the insertion groove 21 side by clothespin action during installation or dismantling of the pipe SP can be done extremely simply and easily.

Figure 10:
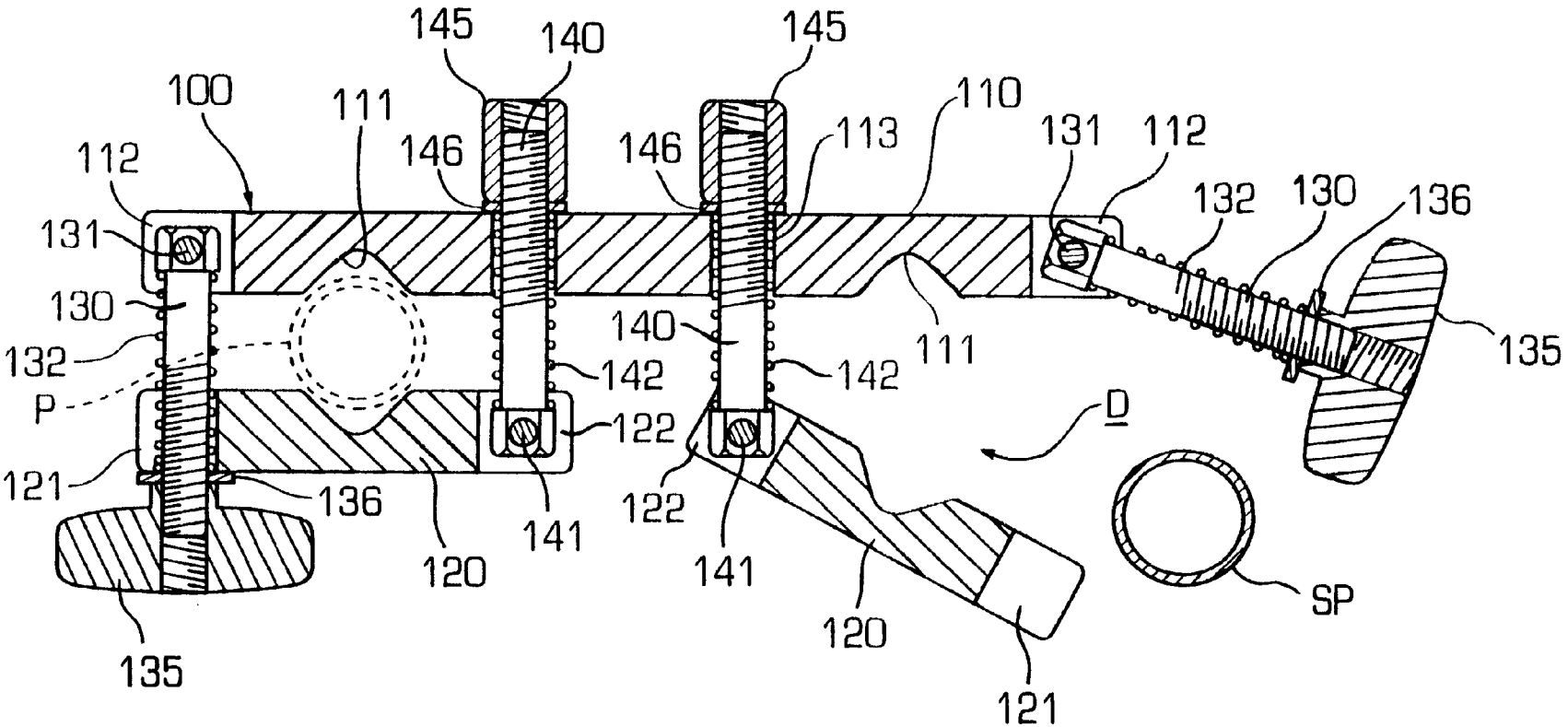
FIG. 10 PRIOR ART
FIG. 10 is a cross section of the clamp device for musical instruments according to prior art.

A clamp mechanism can be provided symmetrically between the right and left with respect to the clamp main body, as is ordinarily done with this kind of clamp devices for musical instruments, as suggested in the prior art FIG. 10. Alternatively, it is possible to adopt different installation mechanisms for the right and for the left, as shown in FIGS. 2–4.

A cut 17 is formed as a continuation from the holding hole 16 at the opposite terminal and also opposite the cut terminal 13 of the clamp main body 11. A third tightening bolt 50 with an external thread cooperates with a third nut 55 tightened on the bolt 50 to tighten or loosen the cut 17. An installation hole 19 is provided in the clamp main body 11 for the third tightening bolt 50. A spring 51 presses on a washer 52.

Figure 7:
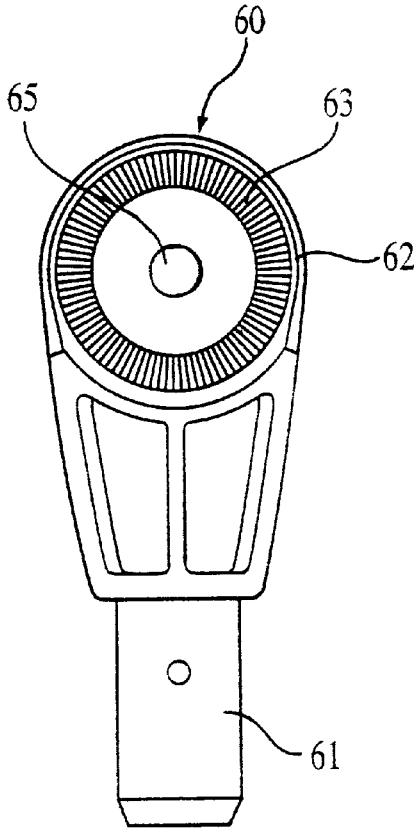
FIG. 7 is a rear view of a holder main body.

The opening 16 receives a separate clamping arrangement as shown in FIG. 2 and FIG. 7. The holding member main body 60 has an insertion part 61 at its bottom, which is in the shape of either a column or a cylinder. The part 61 is inserted into the holding hole 16 of the clamp main body 11. The body 60 has a joining part 62 with an annular engaging part 63 at its top. An installation hole 65 at the center of the annular engaging part 63 receives a fourth tightening bolt 80.

The fourth tightening bolt 80 has a head with a rod insertion hole 81. The bolt 80 is installed on the holder main body 60 through an angle adjusting member 70 which is to be tightened. The rotative connection is fixed by the fourth nut 85. In FIG. 2 the fourth tightening bolt 80 has threads at 82. There are springs 83 and 84 at both sides of the member 70. A washer 80 helps to hold the nut 85.

Figure 8:
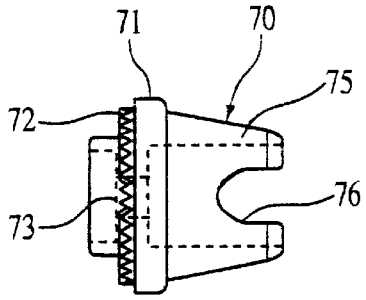
FIG. 8 is a front view of an angle adjustment member.
Figure 9:
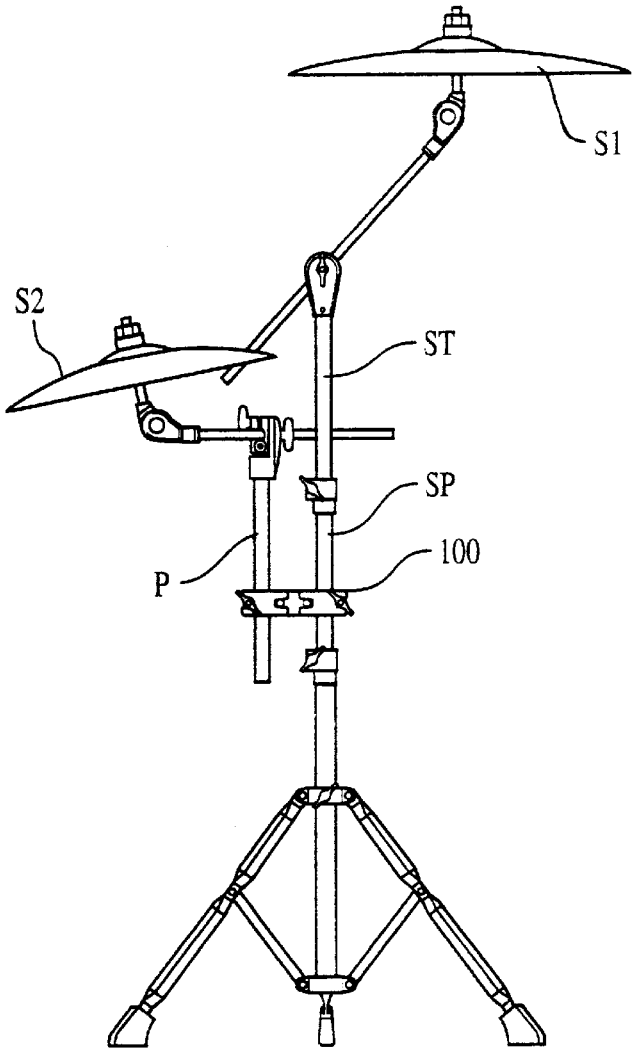
FIG. 9 PRIOR ART
FIG. 9 is a front view of an example of a clamp device for musical instruments according to prior art.

As shown in FIGS. 2 and 8, the angle adjustment member 70 has an annular engaging part 72 that is shaped to engage the annular engaging part 63 of the holding member main body 60 on one side. The member 70 has a rod holder 75 which includes a rod engaging groove 76 that crosses the through hole 73 at a right angle on the other side.

Then the rod R is inserted into the rod insertion hole 81 of the fourth tightening bolt 80. The fourth tightening bolt 80 is inserted into the through hole 73 of the angle adjustment member 70 and the installation hole 65 of the holding member main body 60, and thereafter the bolt 80 has the fourth nut 85 screwed on it.

Subsequent to adjusting the angular position and the length of the rod R by rotating the engaging part 72 of the angle adjustment member 70 so that the rod R may engage the rod engaging groove 76 of the angle adjustment member 70, the fourth nut 85 is tightened. The rod R in the rod insertion hole 81 of the fourth tightening bolt 80 is held by the rod engaging groove 76 of the angle adjustment member 70 at a selected angular position and length adjustment.

FIG. 1 shows the second cymbal S2 held by the rod R. The angular position of the rod R and therefore the position of the second cymbal S2 can be freely adjusted using the angle adjustment member 70.

In the clamp device for musical instruments of the invention, the washer on the main body side slides in contact with the outer peripheral surface at the cut groove of the clamp main body during pivoting of the first tightening bolt, and the position of the first tightening bolt is held as its free pivoting is inhibited. The operator need not continuously rotate the bolt by hand as was required with the prior art.

An arm of the second holder protrudes to the side of the clamp main body. That arm of the second holder enters the clamp main body which makes it possible for that body to move in the longitudinal direction of the arm. A guide window regulates the shift of the arm in the width direction. As a result, the second holder can move only in the direction of approaching or getting away from the clamp main body.

Moreover, the swingable second holder has a spring therein, causing the second holder to perform the installation and dismantling of a pipe in a simple manner using a so-called clothespin action.

Using the invention, installation of a pipe becomes markedly easier, as compared with a conventional construction wherein the pipe must be held at the holder as the operator presses the clamp main body or the second holder by hand. In addition, adjustment of the up and down movement of the position for the pipe that has been held by the holder also becomes simpler.

Moreover, the described design enables the rotation of the nut with moderation and has the effect of stopping the loosening.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A clamp device for clamping a pipe, the clamp comprising:

a main body having a first holder with a surface for engaging the pipe to be clamped;

a second holder with a surface in opposition to the surface of the main body, whereby the pipe may be clamped between the first holder on the main body and the second holder;

a first tightening bolt pivotally attached to the main body at one side of the first holder and pivotable to engage the second holder and to swing away from the second holder, the second holder having a groove therein into which the first bolt is swingable; a first nut to be screwed onto the first bolt while the first bolt is in the groove in the second holder thereby clamping the main body and the second holder together by the first bolt and the first nut;

an installation hole extending through the second holder at the opposite side of the first holder of the main body from the first bolt; a second bolt spaced on the other side of the first holder from the first bolt and the second bolt extending through the installation hole in the second holder; the installation hole being shaped so that the second holder may be swingable with respect to the clamp main body and with respect to the second bolt held in the main body;

a second nut screwed onto the second bolt and located at the side of the second holder away from the main body, whereby the second bolt and second nut hold the second holder to the main body and clamp the second and first holders to a pipe in cooperation with the first bolt and the first nut;

an arm protruding to the side of the second holder past the second bolt, and away from the first bolt, the arm being operable to pivot the second holder with respect to the second bolt and nut to open the clamping of the first and second holders.

2. The clamp device of claim 1, further comprising a first spring at the second bolt for urging the second holder away from the clamp main body at the second bolt, and operation of the arm of the second holder to pivot the second holder with respect to the second bolt is in opposition to the bias of the first spring.

3. The clamp device of claim 2, further comprising a second spring on the first bolt normally biased against the main body near where the first bolt is pivotally attached to the main body and the bias of the second spring resisting the pivoting of the first bolt around its pivot with respect to the main body.

4. The clamp device of claim 2, further comprising a guide window in the clamp main body positioned for the arm of the second holder to enter the guide window, whereby the arm may move through the window and the window regulates the movement of the arm in the width direction.

5. The clamp device of claim 2, wherein the second holder has concave groove with a curved face in the width direction and that crosses the through hole for the second bolt in the second holder; the second nut has a projection with a curved surface in the width direction that extends across the second nut and is in opposition to the concave groove in the second holder for forming a locking connection between the second nut and the second holder which inhibits rotation of the second nut with respect to the second holder.

6. The clamp device of claim 2, wherein the main body extends beyond and away from the second holder in a continuation of the main body, the continuation having a terminal end region, a third hole being formed through the terminal end region, and a third holder for the third hole.

7. The clamp device of claim 6, wherein the main body is cut through the terminal end region and to the third hole defining cut portions; a third bolt extends between the cut portions of the terminal end region, and a third nut is tightened on the third bolt for clamping an object in the third hole.

8. The clamp device of claim 7, further comprising a third holder with a body portion in the third hole; a pipe insertion and angle adjustment member positioned in the third holder;

a fourth tightening bolt, a hole through the fourth bolt;

a fourth nut for being tightening on the fourth tightening bolt for tightening the fourth tightening bolt so as to hold a rod in the hole in the fourth tightening bolt and against the angle adjustment member for holding the orientation and position of the rod with respect to the body of the third holder.

9. The clamp device of claim 1, further comprising a spring on the first bolt normally biased against the main body near where the first bolt is pivotally attached to the main body and the bias of the spring resisting the pivoting of the first bolt around its pivot with respect to the main body.

10. The clamp device of claim 9, further comprising a washer at the first bolt and positioned for engaging the main body and the spring at the first bolt biasing the washer against the main body, the main body being shaped so as to cooperate with the washer biased against it to resist pivoting of the first bolt with respect to the body, and the washer being in sliding contact with the outer peripheral surface of the main body.

11. The clamp device of claim 9, further comprising a groove in the clamp main body and the first bolt being pivotally mounted to the main clamp body at the groove; and an insertion groove at an end of the second holder, and the first bolt being pivotable into the insertion groove, and the first nut on the first bolt holding the first bolt in the insertion groove on the second holder.

* * * * *